United States Patent [19]

Barr

[11] 4,122,561

[45] Oct. 31, 1978

[54] FLOATABLE COVER CAPABLE OF PARTIALLY OR FULLY COVERING SWIMMING POOLS

[76] Inventor: William D. Barr, 16614 Meadow Rd., Lynnwood, Wash. 98036

[21] Appl. No.: 764,749

[22] Filed: Feb. 2, 1977

[51] Int. Cl.[2] ..... E04H 3/19; E04H 3/16

[52] U.S. Cl. ..... 4/172.12

[58] Field of Search ..... 4/172.12, 172.13, 172.14

[56] References Cited

U.S. PATENT DOCUMENTS

| | | | |
|---|---|---|---|
| 3,600,721 | 8/1971 | Pusey | 4/172.12 |
| 3,747,131 | 7/1973 | Koliomichalis | 4/172.12 |

*Primary Examiner*—Harry N. Haroian

*Attorney, Agent, or Firm*—Roy E. Mattern, Jr.; David H. Deits

[57] ABSTRACT

An easily removed or installed cover for swimming pools consists in one form of a cover sheet of flexible sheet material capable of assuming an arched configuration having a periphery in the general shape of the pool. An inflatable air tube is dependently attached by an intermediate supporting wall to the underside of the cover sheet perimeter. The exhaust of a low pressure blower is connected to the air tube by a flexible link of buoyant tubing. The tubing extends beneath the cover sheet from one side of the cover to exhaust air into the air tube on the opposite perimeter. A second low pressure air blower is connected by a second tube to the cover sheet to exhaust air underneath the cover. An apron forming an extension of the cover sheet extends over the edge of the pool and includes provisions for securement to the pool structure. In another embodiment the tube connecting the air tube to its associated blower enters the air tube on one side of the pool and runs within the air tube around the perimeter of the pool to the opposite side where it exhausts into the air tube. Other embodiments include a single blower with an air diversion valve and an auxiliary cover.

21 Claims, 11 Drawing Figures

FLOATABLE COVER CAPABLE OF PARTIALLY OR FULLY COVERING SWIMMING POOLS

BACKGROUND OF THE INVENTION

1. Field of the Invention

The invention relates to an easily removed and inserted floating cover for swimming pools and the like.

2. Prior Art

When swimming pools either above ground or below ground are not in use, regardless of the season, most owners wish to cover them in order to keep debris such as rain and blowing leaves out of the pool. It is a further advantage of covering that pool heat and chemicals which are added to the pool water are conserved.

One type of pool cover consists of an inflatable structure secured about the exterior perimeter of the pool and maintained in an inflated dome shape by the introduction of air under pressure beneath the covering. The U.S. Pat. No. 3,353,309 (Kwake) illustrates such a cover. U.S. Pat. No. 3,810,262 (Strand) illustrates a control for a blower motor to maintain such a structure in an inflated condition.

U.S. Pat. Nos. 3,366,977 (Koehler) and 3,533,110 (Gisondi) illustrate a type of cover in which an inflated floating enclousure forming or supporting the cover is used.

The U.S. Pat. No. 3,523,308 (Bradley) illustrates a cover for an above ground pool which consists of a membrane having a weighted perimeter which extends over the upper projecting rim of the pool to hold the cover in place.

The U.S. Pat. No. 3,747,131 (Koliomichalis) illustrates an inflated domed structure supported on a pair of tubes which abut the pool perimeter. The upper tube is filled with air and the lower tube with water. An apron is provided around the sides to extend over the edge of the pool.

Other types are illustrated by the U.S. Pat. Nos. 3,801,994 (Brown) and 3,676,880 (Kwake). They illustrate respectively a membrane over the pool surface which has a central portion for captively retaining air inserted beneath it and a sheet cover having its perimeter secured to the edge of the pool and having a weighted movable interior wall.

Among the principal problems encountered in many of the existing pool covers is that the pool cover is heavy and difficult to install and remove. The covers often take several persons working together to install the covers and remove them. The larger dome structures which encompass the entire pool often require an air lock system for entering and leaving the pool. Such an air lock is generally expensive and further adds to the difficulty in installing and removing the cover. Another problem often encountered in many pool covers is that they will not work or will not work well where the common obstructions such as diving boards, ladders, and floating pool dividers are used in or about the pool.

Some pool covers will not support the weight of a child or animal straying onto the cover. Also some designs tend to collect water and debris on their surface rather than shed it.

The above noted shortcomings are among those which this invention solves.

SUMMARY OF THE INVENTION

A removable cover capable of partially or fully covering swimming pools and similar structures is provided.

In a preferred form the cover consists of a non-porous sheet of flexible material capable of assuiming an arched configuration over the pool and having a general shape conforming to the shape of the perimeter of the pool. This cover sheet is preferably constructed of a reinforced vinyl material of approximately 10 mils thickness. An air tube of a polyvinylchloride material of a similar thickness is dependently attached by a short supporting wall of a similar polyvinylchloride material to the under surface of the cover sheet. This air tube floats on the pool surface and abuts the interior perimeter of the pool. A length of flexible corrugated polyvinylchloride tubing connected to a blower on one side of the pool extends beneath the cover structure to connect and exhaust air in a section of the air tube on the opposite perimeter of the pool, preferably the connecting tubing floats upon the surface of the pool. A second length of flexible polyvinylchloride tubing connects a second blower to the cover sheet to discharge air underneath the cover sheet. When the blower connected to the air tube is first turned on the segment of the air tube on the opposite side of the cover inflates first, drawing the cover over the surface of the pool automatically. The other blower may be and is generally turned on at the same time. When the cover envelopes the entire surface of the pool, the air tube as it is inflated forces against the walls of the pool forming an air lock between the upper surface of the pool and the under surface of the cover sheet. The introduction of air beneath the cover by the second blower and tube causes the cover sheet to form the arched shape over the pool to shed rain and other contaminants falling on the pool cover. An apron attached to the perimeter of the cover sheet which extends beyond the perimeter of the pool is drawn and secured over the edge of the pool to prevent the contaminants landing on the pool cover from entering the pool. The air supply blowers are of a low pressure and low power usage type such that they are allowed to continuously run.

In a similar embodiment of the cover, the tube feeding air to the air tube from the first blower enters the air tube on one side of the pool and extends within the air tube around the perimeter of the pool to exhaust on the opposite side of the pool.

In a still further embodiment, the tubes directing air beneath the cover and into the air tube are fed from a single air blower. Air flow to the cover and air tube are controlled by the means of a special valve assembly. The valve assembly in one form consists of a box having a bisecting partition forming an inlet chamber which is connected to the blower exhaust and a further bisected lower chamber having one section connected to each of the two air feeder tube. These latter discharge chambers are connected to the receiving chamber each by an aperture, covered by an inwardly swinging door. The aperture and the door to the chamber supplying the air tube both being larger than the respective components on a cover supply chamber. These doors are connected to opposite ends of a pivot arm located in the receiving chamber. Due to the larger surface area of the door and the aperture in the air tube supply chamber, upon initial activation of the blower, air is diverted to the air tube. Subsequently air is directed beneath the cover as the air tube becomes filled and air flow to the air tube is reduced.

By stopping the installation process or by stopping the blowers to the fully installed cover and drawing the cover partially back from the edge of the pool, a portion of the pool may be exposed for use while leaving the remaining portion covered. This permits use of the exposed portion of the pool.

The described cover can easily be installed by one person in 3 to 6 minutes on a typical swimming pool. The device is not unduly hampered by the presence of floating swimming pool dividers and diving boards and ladders and other obstructions commonly found with pools. The cover need not be tied down unless being left unattended for long periods of time or winds are present and the cover will support hundreds of pounds of weight, avoiding the problem of trapping children or straying pets on the pool surface.

An additional embodiment of the invention consists of an auxiliary cover to separately enclose a segregated portion of a pool such as whirlpool. The cover over the main portion of the pool is substantially in the form described above. An auxiliary cover sheet for covering the segregated portion of the pool has a sheet material attached to its under surface. This forms a bag which when connected by a tube to the space beneath the main cover inflates and supports the auxiliary cover. The main and auxiliary cover are dimensioned so they form a uniformly arched surface over the entire pool.

DETAILED DESCRIPTION OF THE INVENTION

Introduction

A floatable cover for swimming pools and the like is provided. It is capable of fully covering the pool and may be partially removed to expose part of the pool for use. Among the advantages of using a pool cover is the prevention of the entry of contaminants into the pool such as leaves and rain water. This eliminates the majority of skimming and vacuuming otherwise required. Chemicals used in the treatment of the pool water are also conserved. Savings on the order of 80 to 90% over the amount of chemicals otherwise required are typical. The actual savings depends on the local climate and air conditions. The cost of heating a pool can also be reduced substantially by the use of a cover. Again this varies with the climate and air conditions but savings on the order of 65% are typical.

PREFERRED EMBODIMENT

Figure 1:
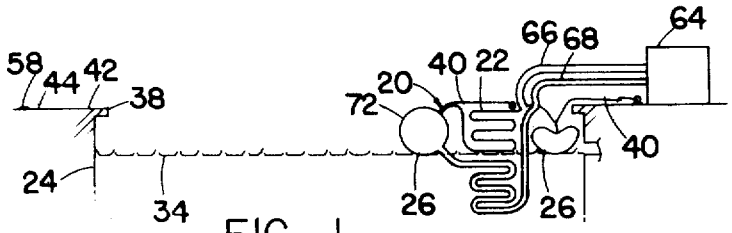
FIG. 1 is a schematic cross sectional view of the pool cover which has been drawn back to expose the pool and is in the process of being inflated to recover the pool.
Figure 4:
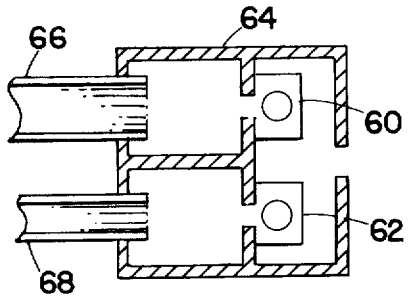
FIG. 4 is a vertical cross section of the air supply blower enclosure of the preferred embodiment.
Figure 2:
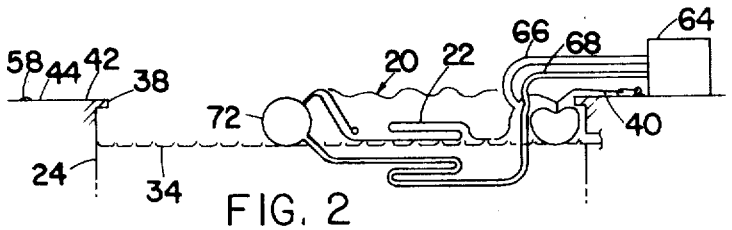
FIG. 2 is a schematic cross sectional view sequentially subsequent to FIG. 1 in the recovering process.
Figure 3:
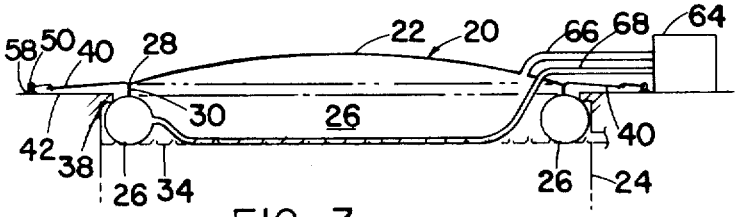
FIG. 3 is a schematic cross sectional view sequentially subsequent to FIG. 3 illustrating the cover fully installed.
Figure 5:
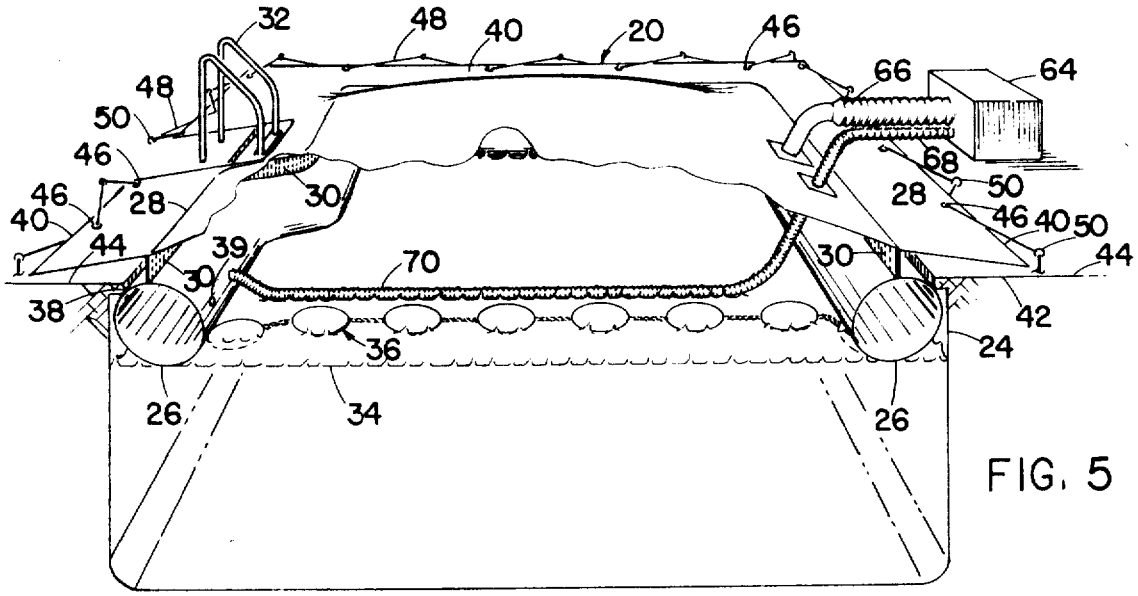
FIG. 5 is a cross sectional view in perspective of the preferred embodiment of the pool cover fully installed.

The pool cover 20 in a preferred form is illustrated in FIGS. 1, 2, 3, 4, 5, and 11. A cover sheet 22 of a nonporous, flexible sheet material having the general shape of the pool 24 is provided. Preferably this is of a material which is easily repaired. A 12 mil reinforced polyvinylchloride material is preferred. The reinforcing consists of a mesh of polyester cord between layers of the polyvinylchloride. Sufficient material is provided so that the cover sheet 22 may assume an arched configuration over the pool when fully installed as shown in FIGS. 3 and 5. An air tube 26 in the approximate shape of the perimeter of the pool is dependently attached to the under surface of the cover sheet 22 at its perimeter 28. In its preferred form the air tube 26 is constructed of a 12 mil polyvinylchloride material which is either heat sealed or ultrasonically welded directly to the cover sheet 22 or as is preferred is connected to it by an intermediate support wall 30. The air tube 26 abuts the perimeter of the pool when the cover is fully installed, passing around typical pool obstructions such as the ladder 32 shown in FIG. 5. The air tube 26 floats on the pool surface 34 and easily passes over floating obstructions such as the pool divider 36 shown in FIG. 5. The air tube may be, and preferably is, sized so that it fits beneath the projecting edge 38 commonly found on pools. Drain plugs 39 are preferably provided in each corner of the air tube 26 to allow drainage of water that may leak into the tube and also aid and speed air evacuation prior to storage of the cover 20. Preferably an apron 40, which forms an extension of the cover sheet 22 and is attached to its perimeter 28, is provided to extend over the edge 42 of the pool. This serves to prevent contaminants that land on the arched cover sheet from entering the pool. It is preferably made the same sheet material as the cover sheet 22. The apron may be secured to the deck 44 around the pool. A preferred form of securement includes grommets 46 spaced about the perimeter of the apron. A cord 48 is laced loosely through the grommets 46 and through intermediately spaced rings 50 of the type shown in FIG. 11. The rings 50 have an appendage 52 which is captively held by a rubber detent 54 in a receiving slot 56 in a relatively flush plate 58 secured to the pool deck 44. These rings 50 and plates 56 are available commercially. Such an arrangement permits the cover 20 to be quickly and easily secured on released. The low profile plates 58 are easily attached to the decking 44 around an existing pool. The cover does not normally have to be secured unless winds are expected.

The cover 20 is maintained in its floating arched configuration by the introduction of air under the cover sheet 22 and within the air tube 26. In the preferred arrangement a pair of low pressure blowers 60 and 62 in an enclosure 64 direct air into two air feeder tubes 66 and 68. One tube 66 is connected to the cover sheet 22 to exhaust air from the blower 60 beneath the cover. The air feeder tube 66 is preferably a flexible, corrugated polyvinylchloride tubing. Air feeder tube 68 is of a similar material preferably, but passes through the cover sheet 22 and extends beneath the cover and across the pool to connect to the air tube 26 on the opposite side of the pool. Preferably the air feeder tube is buoyant so that its intermediate section 70 beneath the cover floats on the pool surface 34 as shown in FIG. 5.

The air is forced into the air tube and beneath the cover at a low pressure. In a typical installation, such as for a 20 × 40 foot pool, using a 4 inch air feeder tube 66 and a 2 inch air feeder tube 68 connected to squirrel cage fan blowers a static pressure of approximately ¾ of column of water beneath the cover and approximately 1 inch of column of water in the air tube 26 is considered to be the most desirable. A Dayton Electric model #4C264, 115 watt blower with a 0.76 inch static pressure rating and model #2C610 80 watt blower with a 0.95 inch static pressure rating, both manufactured by W. W. Granger, Inc. 5959 W. Howard St., Chicago, Ill. 60648; for blowers 60 and 62 respectively were used satisfactorily in an actual installation on a 20 × 40 foot pool. This low pressure inflation prevents the pool cover 20 from lifting off the pool surface 34. Such lifting which occurs with many other types of pool covers allows heat and chemicals to escape. With this cover 20 only the force of winds, particularly when the cover 20 is not tied securely causes it to lift the air tube 26 off the water creating a break in the air seal beneath the cover. Due to the low power requirements necessary to maintain the desired pressure levels the blowers 60 and 62 are allowed to run continuously when the pool is fully covered. The low pressure is sufficient though to maintain the cover 20 in an arched configuration to shed and prevent the pooling of rain water and other contaminants on the cover top surface. The cover does not over inflate and lift off the water surface nor does it collapse under the normal ambient temperature and pressure changes as other cover systems do. The air pressure in the space under the cover sheet 22 holds the air tube against the perimeter of the pool.

To install the cover initially the deflated cover may be laid along the edge of the pool next to the blower enclosure 64. The blowers 60 and 62 are started and the far leading edge 72 of the cover is slid onto the water surface 34. Since the air is just introduced into the portion of the air tube 26 on leading edge this side tends to inflate first and then progressively around the cover perimeter. This causes the cover to draw itself over the surface of the pool automatically with little or no assistance. This action is aided by the introduction of air beneath the cover sheet causing it to float on a cushion of air over the water surface. The relatively light weight cover 20 can be completely installed on a typical 20 × 40 foot pool by one person. Upon completion of the installation the cover assumes the low arched configuration of FIGS. 3 and 5.

If only part of the pool is to be covered the blowers may be turned off and the cover drawn back to an intermediate position, such as shown in FIG. 1 or FIG. 2, to expose part of the pool for use. To re-cover the pool the blowers are turned on and the cover is automatically drawn across the pool as described above, and the apron 40 secured, if desired, as shown sequentially in schematic form in FIGS. 1 through 3.

The cover can be easily removed from the pool when the entire pool is to utilized. Since there are no heavy water filled tubes the cover may be easily removed by one person. The securing connections to the apron 40 is released and the blowers are turned off. The cover is then drawn off the pool on to the decking aided by the still present cushion of supporting air beneath the cover sheet 22. There is no tedious draining of water from tubes nor the cover surface which is held on a cushion of air above the water surface.

FURTHER ADVANTAGES OF THE INVENTION

The pool cover has several more advantages in addition to those described above. The cover is readily adaptable to any size or shape of pool. Its low arched configuration will not obstruct the view across the pool. There is no interference with automatic pool cleaning systems and their need is practically eliminated. The filter pump may be turned off while the pool is covered to save electricity. As a safety factor the cover may be tied down to prevent unauthorized entry and the cover surface will uphold hundreds of pounds of load to support straying children and animals. The arched configuration is self-bailing and prevents collection of pools of water on the cover surface avoiding the creation of a dangerous water filled trap for children and animals.

A SECOND EMBODIMENT

Figure 8:
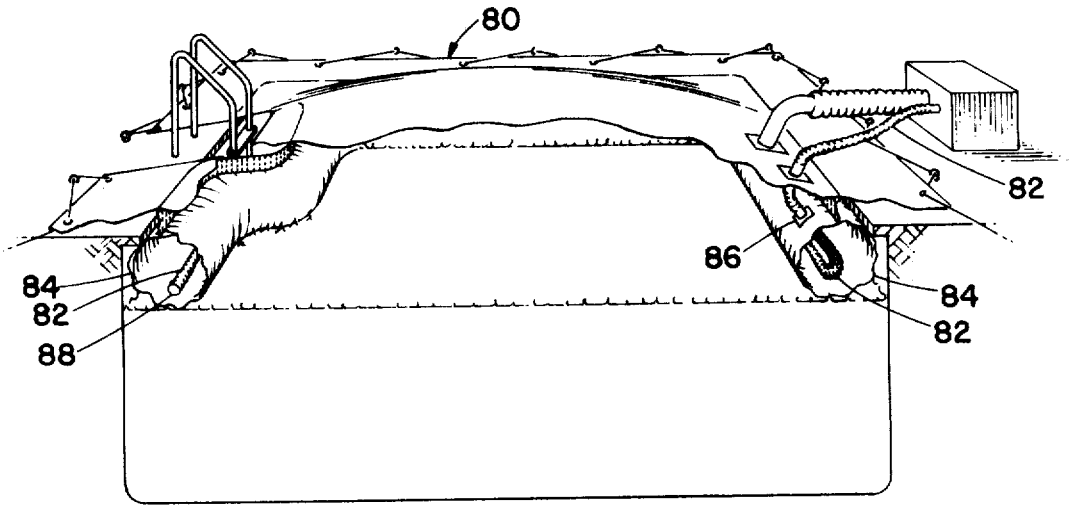
FIG. 8 is a cross sectional view similar to FIG. 5 illustrating another embodiment of the pool cover.

A second embodiment of the pool cover is illustrated in FIG. 8. This cover 80 is identical to the preferred embodiment described above except that the air feeder tube 82 delivering air to the air tube 84 does not extend across the central portion of the pool. The air feeder tube 82, rather, enters the air tube at 86 and extends within the air tube 84 around the perimeter of the pool to exhaust at 88 on the far side of the pool. The purpose of this arrangement is principally, as before, to inflate the far side of the air tube 84 first and draw the cover 80 over the pool surface automatically.

The feeder tube 82 could be terminated at the point 86 where it enters the air tube 84 but the particularly beneficial action described above would not be performed.

A THIRD EMBODIMENT

Figure 6:
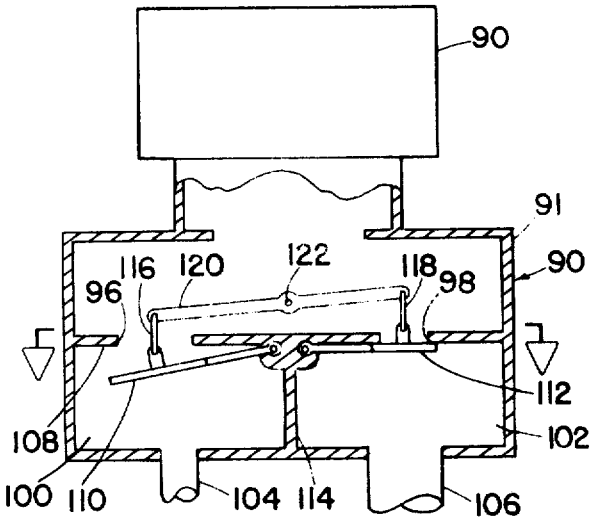
FIG. 6 is a cross sectional view on a horizontal plane through another embodiment of the air supply illustrating a special valve used to sequentially divert the air flow.
Figure 7:
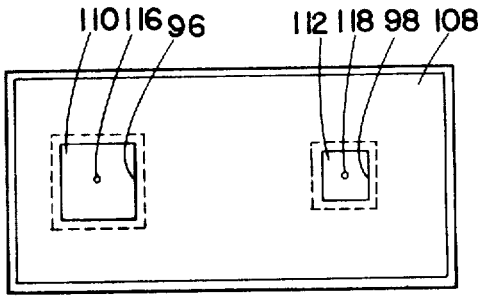
FIG. 7 is a cross sectional view taken on the line shown in FIG. 6.

In the preferred embodiment the air tube is fed by a higher pressure blower so that the inflation of the air tube causes the cover to be drawn over the surface of the pool well before the larger enclosed area under the cover sheet is filled. This sequence of action can also be effected by manual or automatic sequential diversion of air into the two air feeder tubes fed from a single blower. A pressure sensitive sequence valve may be used or the special valve 89 of FIGS. 6 and 7 may be used.

The valve 90 consists of a multi-chamber enclosure 91 fed air under pressure from a blower 92. The air enters a receiving chamber 94 and passes through two openings 96 and 98 into two discharge chambers 100 and 102. These discharge chambers 100 and 102 are connected respectively to the air tube air feeder tubing 104 and the cover sheet air feeder tubing 106. The opening 96 in partition 108 is larger than the opening 98. The opening 96 is preferably approximately 25% larger than opening 98. The openings are coverable by doors 110 and 112 respectively which are hinged near the intermediate partition 114 to pivot inwardly into chambers 100 and 102 respectively. Links 116 and 118 connect the doors 110 and 112 respectively to a pivot arm 120 pivotally connected at 122 to the enclosure 91. Preferably the pivot arm 120 is pivoted closer to the link 118 to the smaller door 112. When the blower 90 is first started when installing the cover the larger surface area of the door 110 causes air to first be diverted to the air tube. This, as described above, draws the cover over the pool. When the air pressure rises in the air tube due to its filling the pressure rises in discharge chamber 100 and door 112 will open to direct most of the air flow beneath the cover sheet. To avoid the effects of the weight differences of the differently sized doors, the doors 110 and 112 are hinged on a vertical axis.

A FOURTH EMBODIMENT

Figure 9:
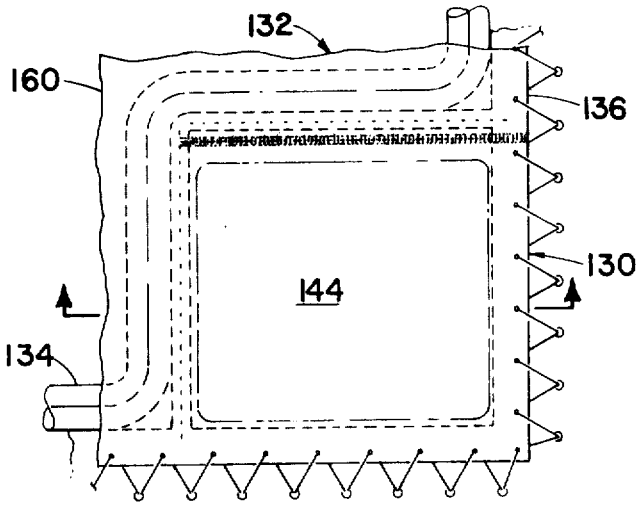
FIG. 9 is a top plan view of an embodiment of the pool cover having a portion capable of covering a segregated portion of the pool such as a whirlpool basin.
Figure 10:
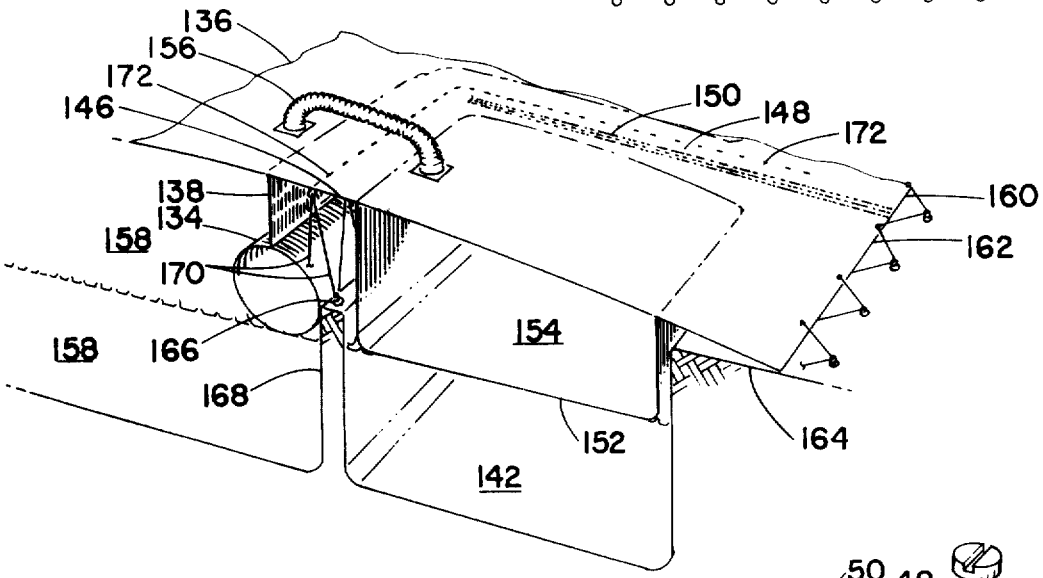
FIG. 10 is a cross sectional view in perspective taken along the line shown in FIG. 9.
Figure 11:
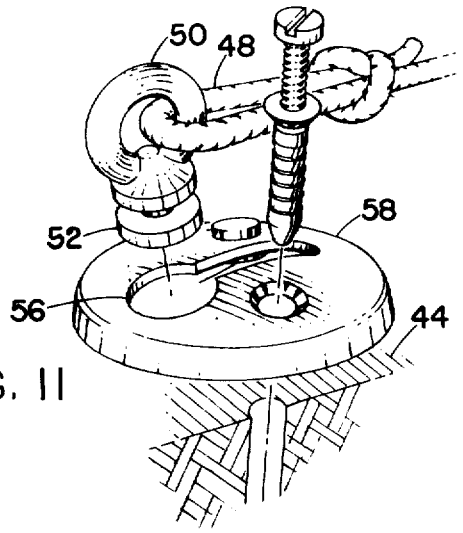
FIG. 11 is a perspective view illustrating the preferred method of connecting the pool cover to the deck surrounding the pool.

In many pools there is a segregated portion such as a whirlpool which is within or adjacent to the main portion of the pool. These separate areas may be covered as illustrated in FIGS. 9 and 10. This permits their use by removal of their cover 130 without the necessity of removing the cover 132 for the main portion of the pool.

The cover 132 for the main portion of the pool is principally the same as the embodiments described above with the exceptions noted below. The main cover 132 has an air tube 134 which extends around the perimeter of the main portion of the pool. In this embodiment the tube support wall 138 is elongated in the area where the main portion 140 of the pool abuts the whirlpool 142. The auxiliary cover sheet 144, also of a flexible, non-porous sheet material, over the whirlpool is attached along one edge 146 to the main cover sheet 136. Along the other common edge 148 a connection such as a zipper 150 is provided to connect them. The elongated tube support wall 138 allows the auxiliary cover sheet 144 to form an extension of the main cover sheet. The contour of the entire cover composed of the parts 130 and 132 is uniform to promote good drainage. The auxiliary cover sheet is supported by the use of a sheet 152 of non-porous flexible sheet material attached to its undersurface. This forms an air space 154 which is connected by tubing 156 to a pressurized region of the main cover 132 such as the area 158 underneath the main cover sheet 136. The pressure under the main cover 132, maintained as described in the other embodiments, inflates the auxiliary cover 130 like a bag to support the auxiliary cover sheet 144. To expose the whirlpool for use the zipper 150 is drawn back to free edge 148 and the auxiliary cover is folded back along line 146 to rest on top of the main cover 132.

Separate aprons 160 and 162 are provided on the covers 132 and 130 to extend over the edge 164 of the pool and serve as described above. Also connections 166 along the wall 168 separating the whirlpool 142 from the main pool 142 are provided to permit a cord 170 to be used to secure the main cover 132 such as by connection under a projecting portion 172 of the main cover sheet 136.

I claim:

1. A floatable cover capable of partially or fully covering swimming pools and the like comprising:

a. a cover sheet of non-porous flexible material which may assume an arched configuration over the pool and having a periphery having the general shape of the pool;

b. an air tube in the approximate shape of the perimeter of the pool and dependently attached at the cover sheet perimeter to the under surface of the cover sheet to abut the interior perimeter of the pool;

c. means for filling the air tube with air having a flexible air feeder tube entering the cover on one side and extending to a point in the air tube on the opposite side of the pool to first introduce air into the latter side of the air tube to inflate that side first so that the cover will automatically draw itself over the pool when the air is first introduced to the deflated cover; and d. means for introducing air beneath the cover sheet, whereby the cover sheet, upon introduction of air, assumes an arched shape to shed rain and other contaminants falling on the cover sheet.

2. A floatable cover capable of partially or fully covering swimming pools and the like, as claimed in claim 1, comprising in addition an apron attached to the perimeter of the cover sheet to extend beyond the perimeter of the pool to form an extension of the cover sheet and means for securing the apron to the pool structure to prevent the disturbance of the cover as by winds.

3. A floatable cover capable of partially or fully covering swimming pools and the like, as claimed in claim 2, comprising, in addition a tube support wall which extends between the cover sheet and air tube to dependently attach the air tube to the cover sheet.

4. A floatable cover capable of partially or fully covering swimming pools and the like, as claimed in claim 2, wherein the feeder tube enters the air tube on one side of the cover and extends within the air tube around the cover perimeter to exhaust within the air tube on the opposite side.

5. A floatable cover capable of partially or fully covering swimming pools and the like, as claimed in claim 2, wherein the feeder tube enters the cover sheet on one side of the cover and extends centrally across beneath the cover sheet and connects to the tube on the opposite side of the cover to exhaust air into the air tube.

6. A floatable cover capable of partially or fully covering swimming pools and the like, as claimed in claim 5, wherein the intermediate section of the feeder tube beneath the cover is buoyant so that it may be supported by the water surface.

7. A floatable cover capable of partially or fully covering swimming pools and the like, as claimed in claim 6, wherein the feeder tube is of a corrugated polyvinylchloride material.

8. A floatable cover capable of partially or fully covering swimming pools and the like, as claimed in claim 2 wherein cover sheet air introduction means comprises a low pressure blower for continuous operation and a flexible air feeder tube connected to the blower and the cover sheet to inflate and maintain the cover sheet in an arched configuration.

9. A floatable cover capable of partially or fully covering swimming pools and the like, as claimed in claim 8 wherein the air tube filling means further comprises a low pressure blower for continuous operation and a flexible air feeder tube connected to the blower and the air tube to introduce air into the air tube and maintain it in an inflated condition conforming to the perimeter of the pool surface.

10. A floatable cover capable of partially or fully covering swimming pools and the like, as claimed in claim 9, wherein the air tube feeder tube enters the cover on one side and extends across beneath the cover sheet and connects to the air tube on the opposite side of the cover to exhaust air within the air tube to first introduce air into the latter side to inflate that side first so that the cover will automatically draw itself over the pool when air is first introduced into the deflated cover.

11. A floatable cover capable of partially or fully covering swimming pools and the like, as claimed in claim 10, wherein the cover comprises a reinforced vinyl.

12. A floatable cover capable of partially or fully covering swimming pools and the like, as claimed in claim 10, wherein the cover sheet blower develops a static air pressure of approximately 1 inch of water and wherein the air tube blower develops a static air pressure of approximately ¾ of 1 inch of water.

13. A floatable cover capable of partially or fully covering swimming pools and the like, as claimed in claim 12, wherein the apron securement means comprises a plurality of grommets about the perimeter of the apron.

14. A floatable cover capable of partially or fully covering swimming pools and the like, as claimed in claim 13, wherein the apron securement means further comprises a cord passing through the grommets and a plurality of rings distributed along the cord, each ring having a projecting appendage for securement in receiving holes which may be placed about the perimeter of the pool.

15. A floatable cover capable of partially or fully covering swimming pools and the like, as claimed in claim 14 wherein the cover feeder tube comprises a 4 inch flexible corrugated polyvinylchloride tubing and the air tube feeder tube comprises a floatable 2 inch flexible corrugated polyvinylchloride tubing which will float on the pool surface.

16. A floatable cover capable of partially or fully covering swimming pools or the like comprising:

a. a cover sheet of non-porous flexible sheet material wich may assume an arched configuration over the pool and having a periphery having the general shape of the pool;

b. an air tube in the approximate shape of the perimeter of the pool and dependently attached at the cover sheet perimeter to the under surface of the cover sheet to abut the interior perimeter of the pool;

c. an apron attached to the perimeter of the cover sheet to extend beyond the perimeter of the pool;

d. means for securing the apron to the pool structure to prevent disturbance of the cover as by winds;

e. an air feeder tube connected to the air tube to permit the introduction of air into the air tube;

f. an air feeder tube connected to the cover sheet to permit the introduction of air underneath the cover sheet;

g. means for supplying air; and h. means, connecting the air supply means to the air feeder tubes, for automatically controlling the supply of air to the air tube and beneath the cover sheet, wherein the air supply control means comprises a multichamber enclosure having a first chamber for receiving air from the air supply means; a second chamber, connected by an opening to the receiving chamber, to which the air feeder tube is connected; a third chamber, connected by a smaller opening to the receiving chamber, to which the cover sheet feeder tube is connected; a pair of inwardly swing doors for covering the opening to the receiving chamber each in the second and third chambers respectively; a pivot arm connected to the enclosure, and a means for connecting each door to opposite ends of the pivot arm so that second chamber door is caused to open more fully upon starting the blowers to inflate the air tube and draw the cover automatically over the pool, then later as the air tube becomes filled and the air flow drops causing the door in the third chamber to open more fully to raise the cover sheet to its arched shape.

17. A floatable cover capable of partially or fully covering swimming pools or the like, as claimed in claim 16, wherein the door in the second chamber is connected to the pivot arm at a point further from the pivot point than the door in the third chamber.

18. A floatable cover capable of partially or fully covering swimming pools or the like, as claimed in claim 17, wherein the first chamber is separated from the second and third chamber by a partition and the second and third chambers are separated by a partition near which the respective doors are pivotally mounted.

19. A floatable cover capable of partially or fully covering a swimming pool of the type having a segregated portion such as a whirlpool chamber, comprising:

a. a main cover sheet of non-porous flexible material over the main portion of the pool, the main cover sheet capable of assuming an arched configuration over the pool and having a periphery the general shape of the main portion of the pool;

b. an air tube in the approximate shape of the perimeter of the main portion of the pool to abut the interior perimeter of the main portion of the pool and which is dependently attached at the main cover sheet perimeter to the under surface of the main cover sheet;

c. means for filling the air tube with air;

d. means for introducing air beneath the main cover sheet;

e. an auxiliary cover sheet of non-porous flexible material over the segregated portion attached to and forming an extension of the main cover sheet;

f. a flexible non-porous sheet material attached to the under surface of the auxiliary cover sheet defining an air enclosure beneath the auxiliary cover which contacts the perimeter of the segregated portion of the pool and supports the auxiliary cover sheet; and g. a tube connecting the main cover with the air enclosure beneath the auxiliary cover so that when the main cover is inflated the auxiliary cover will also be inflated to form a complete covering for the pool having a separate portion which may be moved to expose the segregated portion alone.

20. A floatable cover capable of partially or fully covering a swimming pool of the type having a segregated portion such as a whirlpool chamber, as claimed in claim 19, comprising in addition a tube support wall which extends between the cover sheet and the air tube to dependently attach the air tube to the cover sheet and which is elongated in the region adjacent the segregated portion so that a uniformly arched configuration is formed over the entire pool by the main and auxiliary cover sheets.

21. A floatable cover capable of partially or fully covering a swimming pool of the type having a segregated portion such as a whirlpool chamber, as claimed in claim 20, comprising, in addition, a main cover sheet apron attached to the enterior perimeter of the main cover sheet on that portion bordering the exterior pool perimeter to extend beyond the exterior perimeter of the pool and an auxiliary cover sheet apron attached to the exterior perimeter of the auxiliary cover sheet on that portion bordering the exterior pool perimeters to extend beyond the balance of the exterior perimeter of the pool to form with the main apron an extension of the cover sheet and means for securing the aprons to the pool structure to prevent disturbance of the cover as by winds.

* * * * *